US007604264B2

(12) United States Patent
Lin et al.

(10) Patent No.: US 7,604,264 B2
(45) Date of Patent: Oct. 20, 2009

(54) HOOK SHAFT BALANCE CONNECTION STRUCTURE

(75) Inventors: Shih-Wei Lin, Taipei County (TW); Chih-Hsiung Liao, Taipei County (TW)

(73) Assignee: Quanta Computer Inc., Tao Yuan Shien (TW)

( * ) Notice: Subject to any disclaimer, the term of this patent is extended or adjusted under 35 U.S.C. 154(b) by 139 days.

(21) Appl. No.: 11/896,684

(22) Filed: Sep. 5, 2007

(65) Prior Publication Data

US 2008/0296911 A1 Dec. 4, 2008

(30) Foreign Application Priority Data

Jun. 1, 2007 (TW) ..... 96209092 U

(51) Int. Cl.
*E05C 19/00* (2006.01)
*E05C 1/08* (2006.01)

(52) U.S. Cl. ..... 292/1; 292/137; 292/163; 292/DIG. 37; 292/DIG. 61

(58) Field of Classification Search ..... 292/1, 292/137, DIG. 37, DIG. 61, 163
See application file for complete search history.

(56) References Cited

U.S. PATENT DOCUMENTS 1,857,943 A * 5/1932 Dawicki, Jr. ..... 292/207
6,890,008 B1 * 5/2005 Chuang et al. ..... 292/121
7,054,149 B2 * 5/2006 Lev et al. ..... 361/679.58
7,216,900 B2 * 5/2007 Liu et al. ..... 292/98
7,354,080 B2 * 4/2008 Lee ..... 292/162
2004/0189017 A1 * 9/2004 Chen et al. ..... 292/251.5

* cited by examiner

*Primary Examiner*—Carlos Lugo
(74) *Attorney, Agent, or Firm*—Rabin & Berdo, PC

(57) ABSTRACT

A hook shaft balance connection structure includes an operating element, a balance rod, and a connecting part. The operating element moves into a shell along the direction of the imposed force. The operating element includes a protrusion toward the direction of the force. The balance rod includes two axial parts and an eccentric part. The axial parts are on both ends of the balance rod, pivotally connected with the shell. The axes of them are on the same extension line. The eccentric part is disposed between the two axial parts, deviating from the axial parts by a predetermined distance. Its axis is parallel to those of the two axial parts. The eccentric part includes a first eccentric part in contact with the protrusion of the operating element and a second eccentric part by the first eccentric part. The connecting part includes a pushing part and two coupling parts. The pushing part is connected with the second eccentric part. The two coupling parts are connected to both ends of the connecting part.

4 Claims, 4 Drawing Sheets

HOOK SHAFT BALANCE CONNECTION STRUCTURE

RELATED APPLICATIONS

This application claims priority to Taiwan Application Serial Number 96209092, filed Jun. 1, 2007, which is herein incorporated by reference.

BACKGROUND OF THE INVENTION

1. Field of Invention

The invention relates to a hook shaft balance connection structure and, in particular, to a hook shaft balance connection structure that can release the coupling of two hooks at a farther distance at about the same time.

2. Related Art

The open/close mechanism of the laptop computer body (lower cover) and the display (upper cover) is schematically shown in FIG. 1. Both the left and right ends of the upper edge of the upper cover are provided with a hook (not shown). A coupling part 801 hidden inside the lower cover 900 is manipulated by a long push button 800 at the center of the edge of the lower cover to release the hooks. For this kind of open-close mechanism, the long push button 800 and the coupling part are often integrally formed for a direct, connection. If no force is imposed on the central part of the long push button 800 (e.g., the force is imposed on the left or right side of the long push button 800), then the displacement of the coupling part 801 on the force side is larger than that on the other side. In that case, only the hook closer to the force imposing point is released. Therefore, the user has to push exactly the central part of the long push button 800 or push the long push button 800 several times in order to decouple the upper and lower covers. This is very inconvenient.

It is necessary to improve the open/close mechanism of such push buttons, so that the user can release the couplings of both hooks at the same time by pushing any part of the button.

SUMMARY OF THE INVENTION

Therefore, an objective of the invention is to provide a hook shaft balance connection structure that can decouple two hooks at a distance roughly simultaneously.

To achieve the above-mentioned objective, the disclosed hook shaft balance connection structure is inside the shell of a device with a cover and a body for controlling the open/close of them. The structure includes an operating element, a balance rod, and a connecting part. The operating element moves into the shell along the direction of an external force. The operating element includes a protrusion toward the force exerting direction. The balance rod is formed by bending a cylindrical body and includes two axial parts and one eccentric part. The axial parts are on both ends of the balance rod. The two axes are on the same extension line. The two axial parts are pivotally connected to the shell. The eccentric part is disposed between the two axial parts, deviating from the axial parts by a predetermined distance. The axis of the eccentric part is parallel to the axes of the two axial parts. The eccentric part includes a first eccentric part in touch with the protrusion of the operating element and a second eccentric part by the first eccentric part. The connecting part is disposed between the shell and the balance rod, including a pushing part and two coupling parts. The pushing part is provided on the connecting part and coupled with the second eccentric part. The two coupling parts are provided on both ends of the connecting part.

In the disclosed hook shaft balance connection structure, the operating element includes a force exerting part protruding from the shell.

In the disclosed hook shaft balance connection structure, the protrusion of the operating element has an arc shape.

The disclosed hook shaft balance connection structure further includes an elastic body disposed between the hook shaft balance connection structure and the shell, exerting an elastic force on one of the operating element, the balance rod, and the connecting part.

In the disclosed hook shaft balance connection structure, the first eccentric part and the second eccentric part have different eccentricities.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
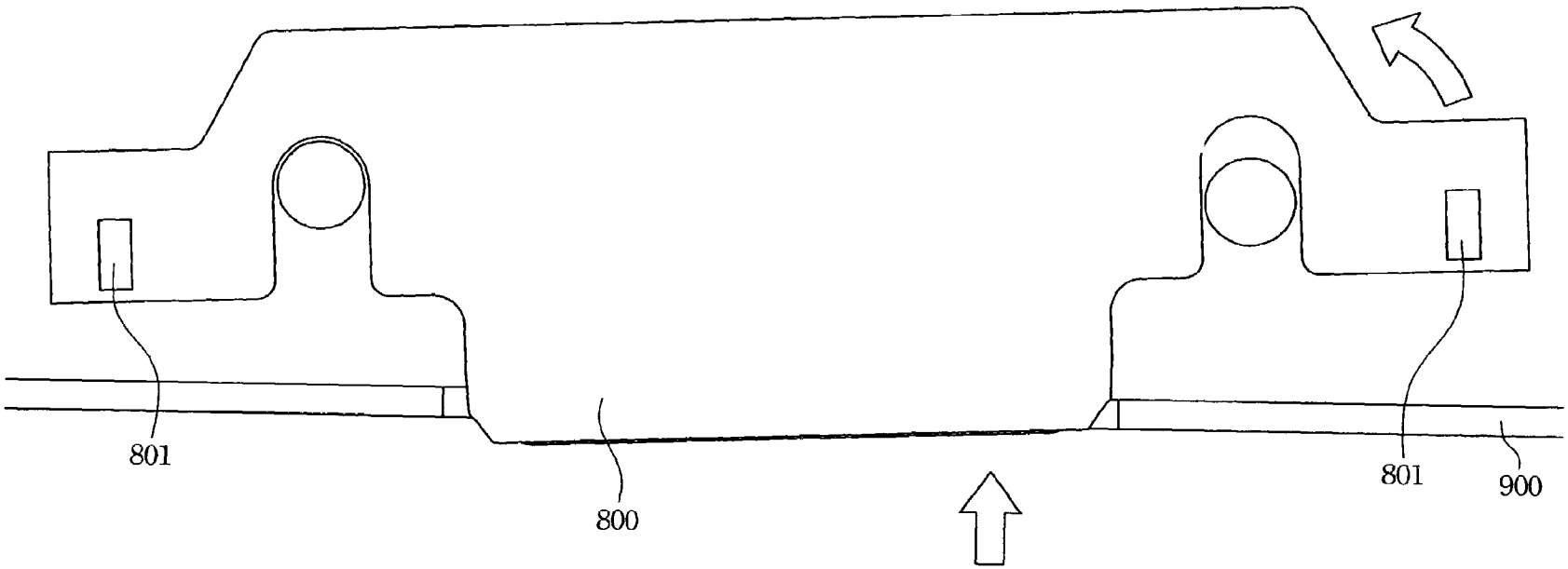
Fig. 1 (PRIOR ART)
FIG. 1 is a top view of a conventional open/close mechanism.
Figure 2:
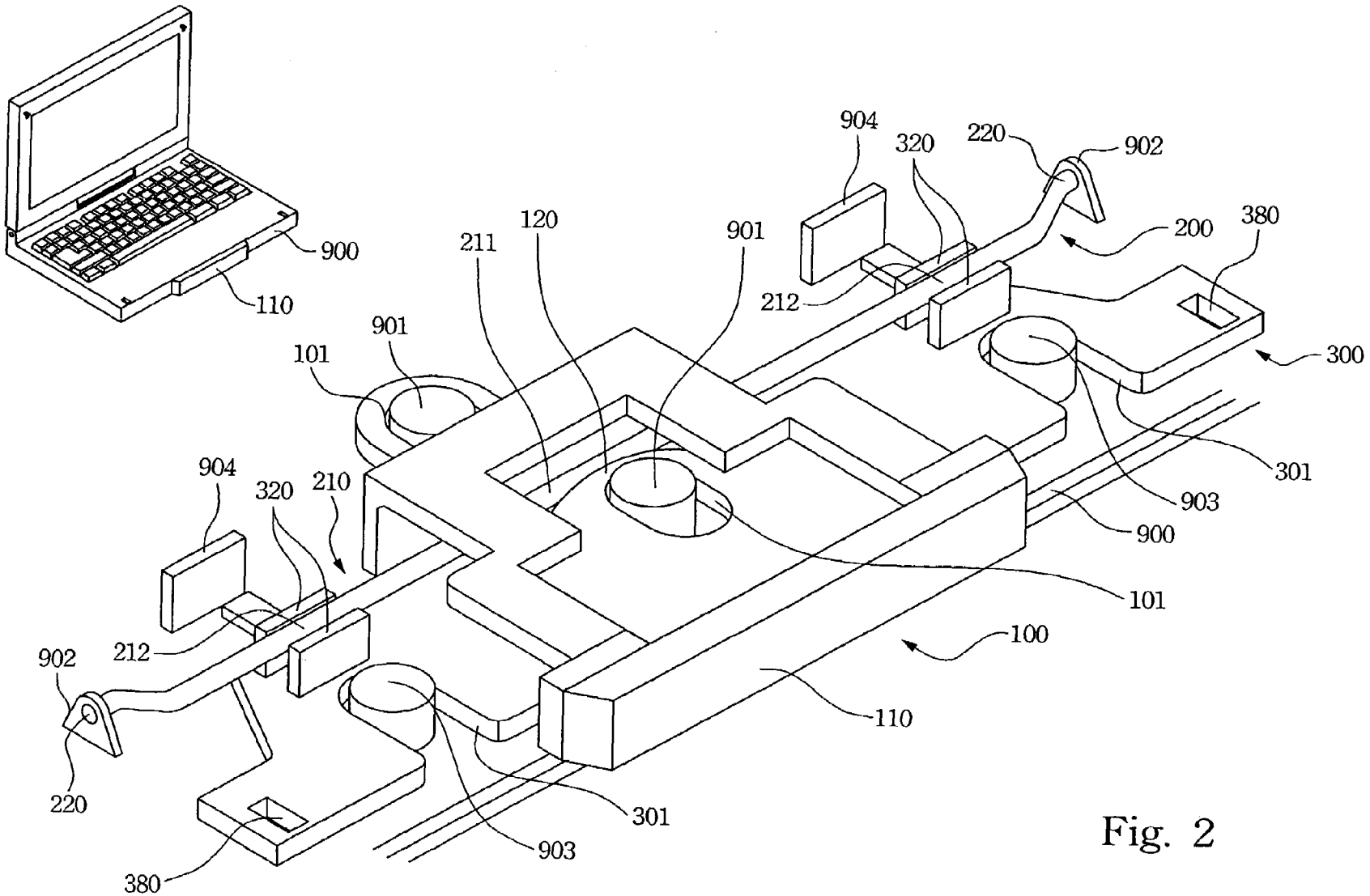
FIG. 2 is a three-dimensional view of a laptop computer using the disclosed hook shaft balance connection structure.
Figure 3:
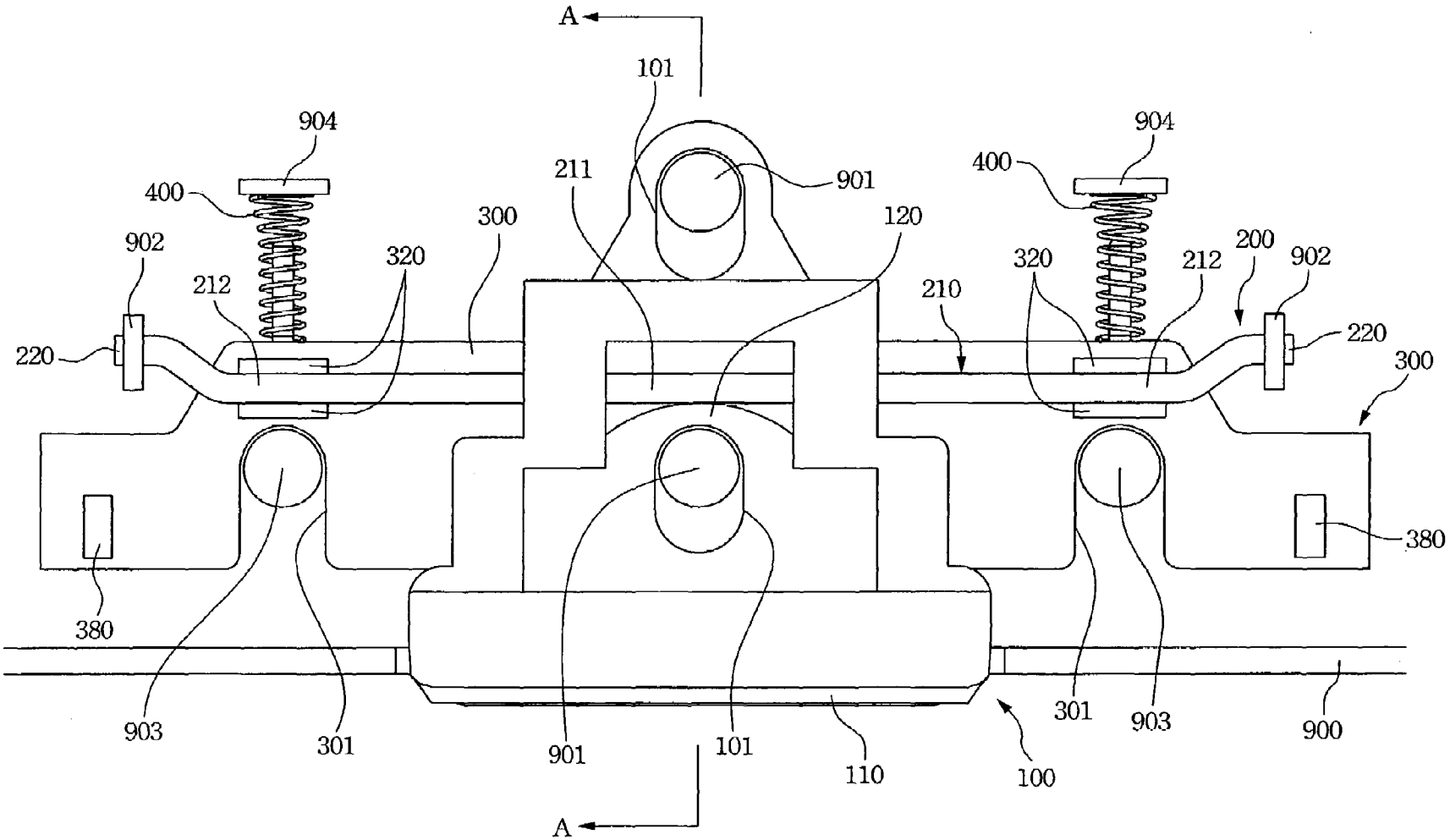
FIG. 3 is a top view of an embodiment of the disclosed hook shaft balance connection structure.
Figure 4:
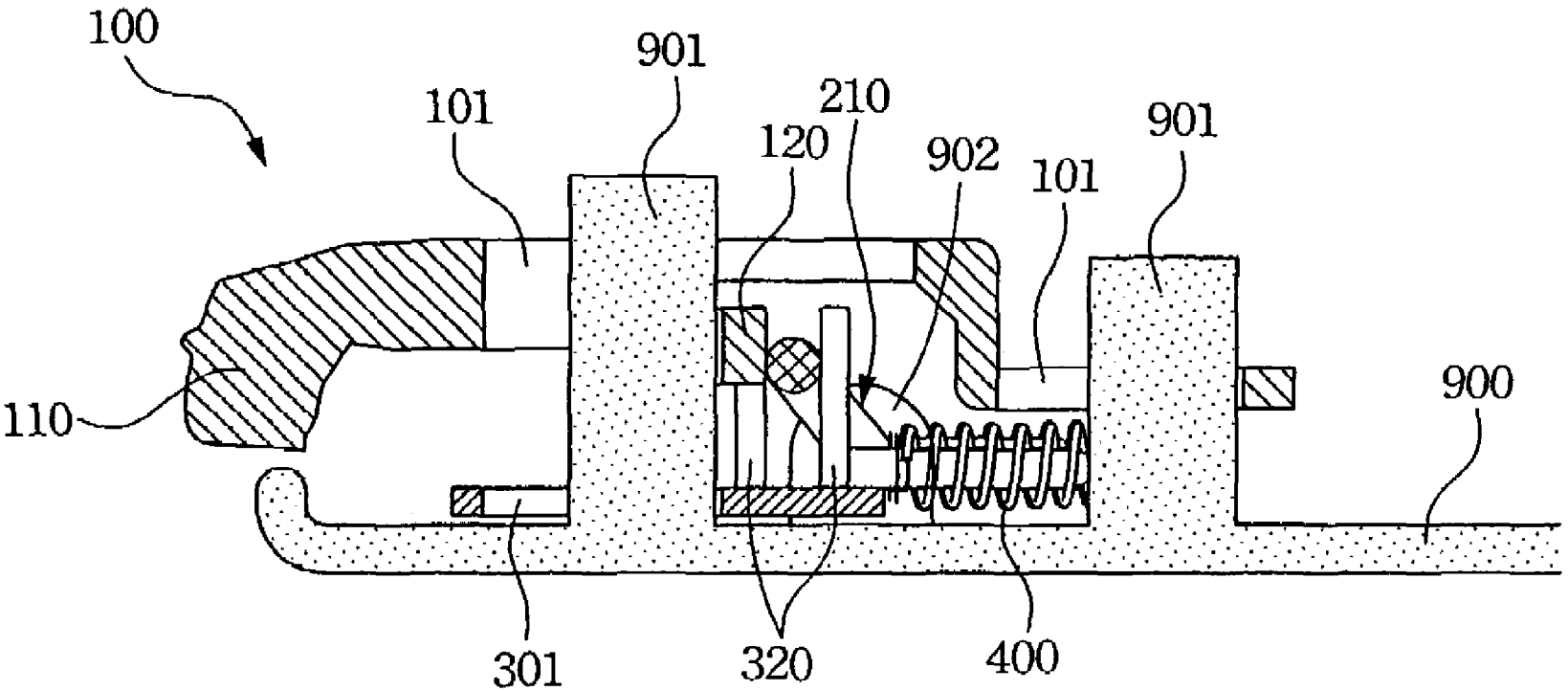
FIG. 4 is a cross-sectional view of FIG. 3 along the A-A line.

FIG. 2 is a three-dimensional view of an embodiment of the disclosed hook shaft balance connection structure and a laptop computer using the same. FIG. 3 is a top view of an embodiment of the disclosed hook shaft balance connection structure. FIG. 4 is a cross-sectional view of FIG. 3 along the A-A line. As shown in the drawing, the hook shaft balance connection structure is disposed inside a shell 900, and includes an operating element 100, a balance rod 200, and a connecting part 300.

The operating element 100 is a pushing button. The operating element 100 preferably moves vertically along the edge of the shell 900. The operating element 100 is formed with a sliding groove 101, extended to the center of the operating element 100 along the moving direction of the operating element 100. The sliding groove 101 and a protruding guide 901 on the shell 900 match with each other, limiting the sliding range of the operating element 100. The relative stroke between the sliding groove 101 and the protruding guide 901 has to match the distance for releasing the hooks (not shown) from the following decoupling parts 380. The operating element 100 is provided with a force exerting part 110 protruding from the shell 900. When a force is exerted on the force exerting part 110, the operating element 100 slides along the sliding groove 101 under the guide of the protruding guide 901. The operating element 100 includes a protrusion 120 located symmetrically at the center of the operating element 100 and protruding toward the force exerting direction. Moreover, the protrusion 120 preferably has an arc shape.

The balance rod 200 is formed by bending a cylindrical body. In this embodiment, the balance rod 200 is bent to have a bow shape, divided into an eccentric part 210 and axial parts 220. The axial parts 220 are located on both ends of the balance rod 200. The eccentric part 210 is between the two axial parts 220. The axis of the eccentric part 210 and those of the axial parts 220 are separated by a predetermined distance. The two axial parts 220 are pivotally connected to the bearing 902 on the shell 900. The axes of the two axial parts 220 extend coaxially. The extension lines of the two axial parts 220 are preferably parallel to the edge of the shell 900. The axis of the eccentric part 210 is parallel to the extension lines of the axes of the two axial parts 220. The length of the eccentric part 210 is preferably close to the distance between the following two coupling parts 380 in order to provide better connecting effects. The eccentric part 210 includes a first eccentric part 211 in touch with the protrusion 120 of the operating element 100 and a second eccentric part 212 located by the first eccentric part 211 and coupled with the following pushing part 320 of the connecting part 300. The first eccentric part 211 is in touch with the protrusion 120. The protrusion 120 pushes the eccentric part 210 of the balance rod 200, so that the entire balance rod 200 rotates respect to the two axial parts 220. It is preferable to have only a small contact area between the first eccentric part 211 and the protrusion 120. It is most favored if the contact is only a single point.

The connecting part 300 is located between the shell 900 and the balance rod 200. The connecting part 300 is formed with a sliding groove 301, extending along the moving direction of the operating element 100. The sliding groove 301 matches with the protruding guide 903 on the shell 900 for limiting the sliding range of the connecting part 300.

The connecting part 300 is provided with two pushing parts 320. The second eccentric part 212 of the balance rod 200 couples with the two pushing parts 320, rotating and moving inside the pushing parts 320. In this state, the extension line between the two pushing parts 320 is also preferably parallel to the edge of the shell 900 as the above-mentioned balance rod 200.

To prevent the balance rod 200 from getting off the pushing parts 320 during operation, it does not decouple from the pushing parts 320 no matter how it rotates, as shown in the cross-sectional side view in FIG. 4. In this embodiment, the height of the pushing parts 320 has to be larger than that of the second eccentric part 212 after it rotates to be perpendicular to the shell 900.

The connecting part 300 is provided with two coupling parts 380, parallel to the edge of the shell 900 and located on both ends of the connecting part 300.

Besides, as shown in FIG. 3, the shell 900 is provided with a stopping part 904. A spring body 400 is disposed between the stopping part 904 and the connecting part 300, exerting an elastic force on the connecting part 300 in the direction opposite to the imposing force of the operating element 100. In this embodiment, two elastic bodies 400 of the same elasticity are disposed symmetrically between the stopping part 904 and the connecting part 300.

The following paragraphs explain the actions of the disclosed hook shaft balance connection structure.

In the beginning, the force exerting part 110 protrudes from the shell 900. When a force is imposed on the force exerting part 110 toward the shell 900, the operating element 100 slides along the sliding groove 101 and under the guide of the protrusion 901. At the same time, the protrusion 120 urges against the first eccentric part 211 of the balance rod 200.

In this case, even if the force is imposed on any position of the force exerting part 110, the operating element 100 deviates toward any direction other than perpendicular to the eccentric part 210. Since the protrusion 120 has a contact with the first eccentric part 211 by a small area, the push on eccentric part 210 of the balance rod 200 makes it rotate with respect to the axial parts 220. Viewing from the top, the eccentric part 210 of the balance rod 200 moves parallel to the edge of the shell 900. Afterwards, the two pushing parts 320 of the connecting part 300 are pushed by the second eccentric part 212 of the balance rod 200. The connecting part 300 moves parallel to the edge of the shell 900 along the pushing direction. The two coupling holes 380 on both ends of the connecting part 300 also move in equal distance. Using this mechanism, the hooks (not shown) that catch the two coupling holes 380 can thus be released roughly at the same time. This solves the problem of unable to release the hook on one side in the prior art.

At the same time the force on the operating element 100 pushes the balance rod 200 and the connecting part 300, the elastic body 400 between the connecting part 300 and the shell is compressed. Once the imposed force is removed, the elastic body 400 releases the elastic force, pushing the operating element 100, the balance rod 200, and the connecting part 300 back to the initial state.

The invention has all kinds of variations. For example, the shapes of its components are not limited to those shown in the drawings. The invention only requires that the two coupling parts 380 separated by a distance can release the hooks (not shown) roughly at the same time when one imposes a force in an arbitrary direction on the operating element. In this case, the protrusion 120 touches and pushes the balance rod 200 to move the connecting part 300 in a parallel way. The above embodiment uses two pushing parts 320 as an example. However, having the protrusion 120 and one pushing part 320 concentrated in the central position of the balance rod 200 can also achieve the same effect. It is preferably to have two elastic bodies 400 disposed symmetrically. As long as the operating element 100, the balance rod 200, and the connecting part 300 can be pushed back to the initial state, there are no restrictions on the number and positions of the elastic bodies 400. For example, the above-mentioned embodiment has two elastic bodies 400 in the connecting part 300. However, the elastic bodies 400 can be disposed between the balance rod 200 and the shell 900 or between the operating element 100 and the balance rod 200. When there is a contact in the direction of restoring to the original state, the elastic body 400 can be disposed between the operating element 100 and the shell 900. Besides, considering the magnitude of force on the operating element 100 and the relative position between the operating element 100 and the connecting part 300, the first eccentric part 211 and the second eccentric part 212 can deviate different distances in order to reduce the required force or shorten the operating stroke. In the above-mentioned embodiment, the coupling part 380 is a hole that matches with a hook (not shown). However, the coupling part can be a hook and a hole is formed at a corresponding position as well. Such variations should be construed as part of the invention.

Therefore, the disclosed hook shaft balance connection structure can release two hooks at a distance roughly at the same time without the need to repeatedly perform hook releases.

While the invention has been described by way of example and in terms of the preferred embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A hook shaft balance connection structure disposed inside a shell of a device with a cover and a body for controlling the open/close of the cover and the body, the hook shaft balance connection structure comprising:

an operating element moving into the shell along the direction of an external force and having a protrusion toward the direction of the force and a sliding groove that receives a protruding guide on the shell for guiding the movement of the operating element;

a balance rod formed by bending a cylindrical rod and including:

two axial parts on both ends of the balance rod with their axes on a same extension line and pivotally connected to the shell, and an eccentric part disposed between the two axial parts and separated from them by a predetermined distance, with its axis parallel to the axes of the axial parts, the eccentric part having:

a first eccentric part in contact with the protrusion, and a second eccentric part disposed by the first eccentric part;

a connecting part disposed between the shell and the balance rod including:

a pushing part coupled with the second eccentric part, and two coupling parts on both ends of the connecting part;

the eccentric part has a length substantially equal to the distance between the two coupling parts;

an elastic body disposed between the hook shaft balance connection structure and the shell for biasing the structure to its original position;

wherein, when the operating element is operated, the operating element pushes the protrusion against the first eccentric part so as to rotate the balance rod with respect to the axial parts and to make the second eccentric part to contact the pushing part of the connecting part, to move equally the connecting part so as to decouple the two coupling parts from engagement with latch formations on the cover at the same time.

2. The hook shaft balance connection structure of claim 1, wherein the operating element includes a force exerting part protruding from the shell.

3. The hook shaft balance connection structure of claim 1, wherein the protrusion is an arc protrusion.

4. The hook shaft balance connection structure of claim 1, wherein the first eccentric part and the second eccentric part deviate different distances.

* * * * *